US008047260B2

(12) United States Patent
Uno et al.

(10) Patent No.: US 8,047,260 B2
(45) Date of Patent: Nov. 1, 2011

(54) INFILTRATION METHODS FOR FORMING DRILL BITS

(75) Inventors: Timothy P. Uno, Spring, TX (US); Marc W. Bird, Houston, TX (US); Curtis A. Proske, The Woodlands, TX (US); Lester Dupre, Erath, LA (US)

(73) Assignee: Baker Hughes Incorporated, Houston, TX (US)

( * ) Notice: Subject to any disclaimer, the term of this patent is extended or adjusted under 35 U.S.C. 154(b) by 367 days.

(21) Appl. No.: 12/347,424

(22) Filed: Dec. 31, 2008

(65) Prior Publication Data

US 2010/0166592 A1 Jul. 1, 2010

(51) Int. Cl.
*B22D 19/14* (2006.01)

(52) U.S. Cl. ..... 164/97; 164/98

(58) Field of Classification Search ..... 164/97, 164/98; 408/199; 76/108.1, 108.2, 108.4, 76/108.6

See application file for complete search history.

(56) References Cited

U.S. PATENT DOCUMENTS 5,167,271 A * 12/1992 Lange et al. ..... 164/103
5,662,183 A 9/1997 Fang
6,073,518 A 6/2000 Chow et al.
6,200,514 B1 3/2001 Meister
6,220,117 B1 4/2001 Butcher
6,319,437 B1 11/2001 Elsner et al.
6,916,355 B2 7/2005 Kida et al.
6,986,297 B2 1/2006 Scott
7,247,267 B2 7/2007 Kao et al.
7,398,840 B2 7/2008 Ladi et al.
7,441,612 B2 10/2008 Durairajan et al.
2006/0032677 A1 2/2006 Azar et al.
2008/0003323 A1 1/2008 Manuel et al.
2010/0278604 A1 * 11/2010 Glass et al. ..... 408/199

FOREIGN PATENT DOCUMENTS

WO 2008091793 A2 7/2008

OTHER PUBLICATIONS

Monnappa Kokkengada et al.; "Low Viscosity Resin Infiltration Technique Used in Rapid Tooling", International Conference of Flexible Automation and Intelligent Manufacturing, UMD, Maryland, Jun. 2000, 11 pages.

* cited by examiner

*Primary Examiner* — Kuang Lin

(57) ABSTRACT

An infiltration method of forming an article including providing a working mold including a solid binder member extending through an interior of the working mold, wherein the solid binder member is made of a binder material, and providing a layer of powder matrix material within a molding void of the working mold. The method further includes heating the working mold to form a molten binder pathway from the solid binder member to infiltrate the layer of powder matrix material.

20 Claims, 8 Drawing Sheets

INFILTRATION METHODS FOR FORMING DRILL BITS

BACKGROUND

1. Field of the Disclosure

The following is directed to an infiltration process and more particularly an infiltration process for forming earth boring drill bits.

2. Description of the Related Art

Earth boring drill bits are frequently used to form wells in the earths crust in search of natural resources, such as oil, gas, geothermal reserves, and water. The formation of such wells can be accomplished, by the use of different types of drill bits, including for example, rotary drill bits or fixed cutter drill bits. Current fixed cutter drill bits can be complex mechanical components having particular designs including certain arrangements of cutting elements at the exterior surface of the drill bit, blade orientations and designs, and fluid flow passages extending through the bit to allow communication of drilling fluids from associated surface drilling equipment through a drill pipe attached to the drill bit. Moreover, the drill bit is typically made of a combination of materials such that it has suitable mechanical properties to survive the rigors of drilling applications.

A variety of processes have been used to form one or more components of such drill bits, including sintering processes, hot pressing processes, and infiltration processes. Sintering is a process of bonding adjacent metal powders by heating a preformed mixture to induce chemical and/or physical changes in the materials used to form the components. In particular, sintering involves the introduction of a mixture of a refractory compound and binder material, which are placed in a mold and heated until the two materials are bonded via diffusion bonding or liquid phase material transport mechanisms. Hot pressing can utilize forming temperatures lower than sintering and high pressures to affect formation or joining of components to form drill bits. Drill bits may also be formed by an infiltration process in which a matrix powder material is infiltrated by a molten binder material at high temperatures through capillary action and gravity. In such processes, the binder material may have a low melting temperature in comparison to binder materials utilized in sintering, and thus the process may utilize temperatures that are lower than sintering. However, infiltration processes can be time consuming and encourage a host of other problems ultimately resulting in insufficient formation of the drill bit.

SUMMARY

According to a first aspect, an infiltration method of forming an article includes providing a working mold including a solid binder member extending through an interior of the working mold, wherein the solid binder member is made of a binder material, and providing a layer of powder matrix material within a molding void of the working mold. The method further includes heating the working mold to form a molten binder pathway from the solid binder member to infiltrate the layer of powder matrix material.

An infiltration method of forming an article including providing a working mold having a molding void for formation of an article therein, wherein the molding void comprises a molding void height ($h_{mv}$) between a bottom surface and a top surface. The working mold also includes a cavity in fluid communication with a bottom half of the working mold. The method further includes providing a layer of powder matrix material within the molding void of the working mold, and heating the working mold and infiltrating a bottom region of the layer of powder matrix material with molten binder material flowing from the cavity into the molding void.

In another aspect, an infiltration method of forming an article includes providing a layer of powder matrix material within a molding void of a working mold, and heating the working mold and forming a molten binder pathway extending through a portion of the layer of powder matrix material and an interior of the working mold into the molding void to infiltrate the powder matrix material. The molten binder pathway has an average diameter significantly greater than an average interparticle porosity of the powder matrix material.

According to another aspect, an infiltration method of forming an article includes providing a solid binder member comprising binder material within a working mold, and providing a layer of powder matrix material within a working mold, wherein the solid binder member extends through a portion of the layer of powder matrix material. The method further includes providing a layer of powder binder material over the powder matrix material, and heating the working mold to form molten binder material thereby simultaneously infiltrating a top region of the layer of powder matrix material and a bottom region of the layer of powder matrix material upon forming the molten binder material, wherein infiltrating the bottom region is conducted along a molten binder pathway defined by the solid binder member.

In a fourth aspect, an infiltration method of forming an article includes forming a working mold having solid binder members contained within an interior space of the working mold and protruding at an interior surface defining a molding void of the working mold, wherein the solid binder members comprise a binder material, and providing a powder matrix material within the molding void. The method also includes heating the working mold to melt the solid binder members to form molten binder material that infiltrates a bottom region of the powder matrix material.

BRIEF DESCRIPTION OF THE DRAWINGS

The present disclosure may be better understood, and its numerous features and advantages made apparent to those skilled in the art by referencing the accompanying drawings.

DETAILED DESCRIPTION

The following is directed to earth boring drill bits, and more particularly, towards methods of forming such drill bits.

The following describes infiltration methods in which a drill bit is cast using powder matrix material contained within a mold that is infiltrated with a binder material to form a final-formed drill bit made of a metal matrix alloy comprising the matrix material and binder material.

The terms "bit", "drill bit", and "matrix drill bit" may be used in this application to refer to "rotary drag bits", "drag bits", "fixed cutter drill bits" or any other earth boring drill bit incorporating teaching of the present disclosure. Such drill bits may be used to form well bores or boreholes in subterranean formations.

Figure 1:
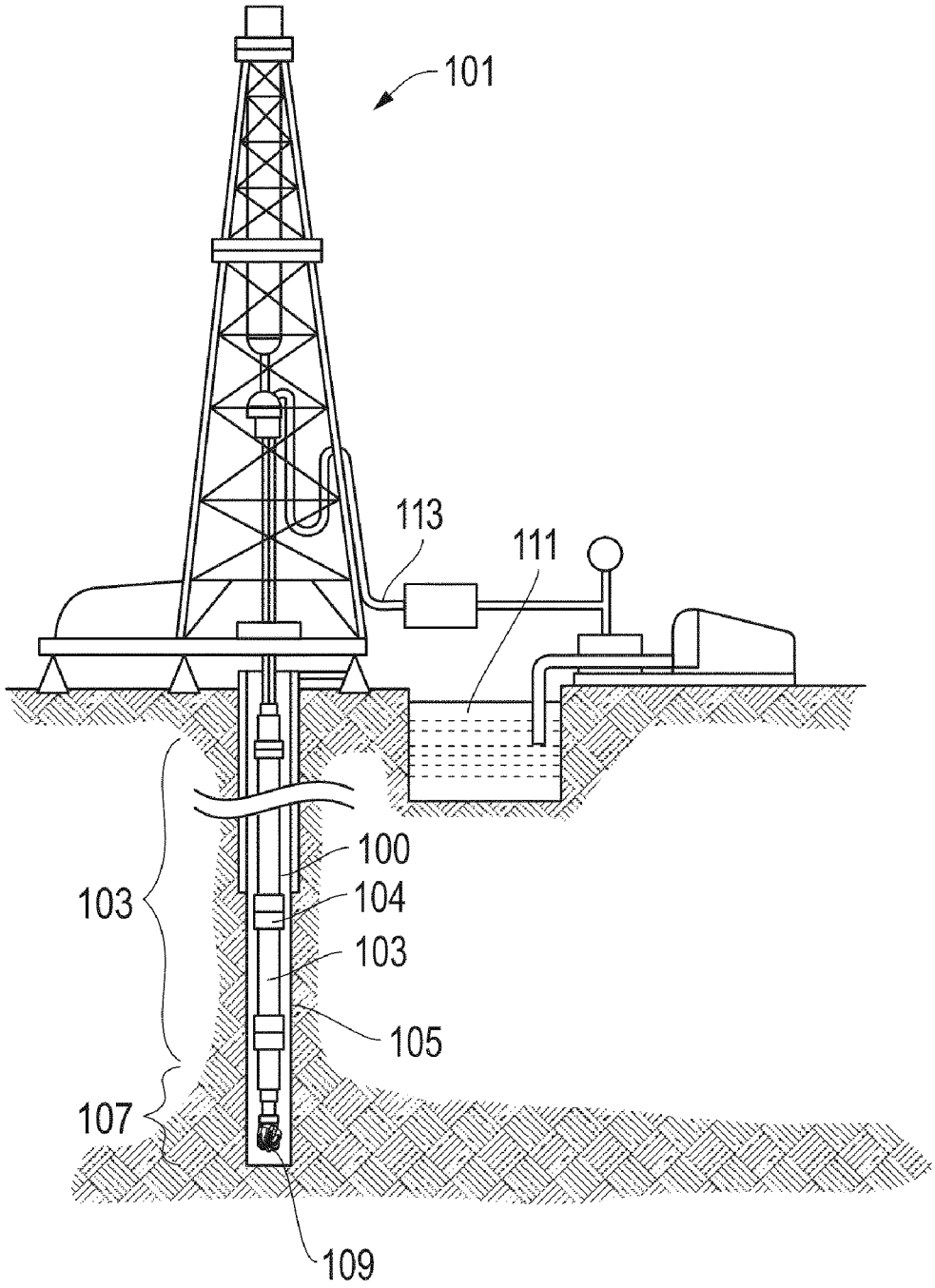
FIG. 1 includes a schematic for a drilling system for drilling earth formations in accordance with an embodiment.

Fixed cutter drill bits, such as polycrystalline diamond compact (PDC) drill bits, are commonly used in the oil and gas industry to drill well bores. An example of a drilling system for drilling such well bores in earth formations is illustrated in FIG. 1. In particular, FIG. 1 illustrates a drilling system including a drilling rig 101 at the surface that is a station for a crew of workers to operate a drill string 103. The drill string 103 defines a well bore 105 extending into the earth and can include a series of drill pipes 100 and 103 that are coupled together via joints 104 facilitating extension of the drill string 103 for great depths into the well bore 105. The drill string 103 may include additional components, such as tool joints, a kelly, kelly cocks, a kelly saver sub, blowout preventers, safety valves, and other components known in the art.

Moreover, the drill string can be coupled to a bottom hole assembly 107 (BHA) including a drill bit 109 used to penetrate earth formations and extend the depth of the well bore 105. The BHA 107 may further include one or more drill collars, stabilizers, a downhole motor, MWD tools, LWD tools, jars, accelerators, push and pull directional drilling tools, point stab tools, shock absorbers, bent subs, pup joints, reamers, valves, and other components. A fluid reservoir 111 is also present at the surface that holds an amount of liquid that can be delivered to the drill string 103, and particularly the drill bit 109, via pipes 113, to facilitate the drilling procedure.

Figure 2:
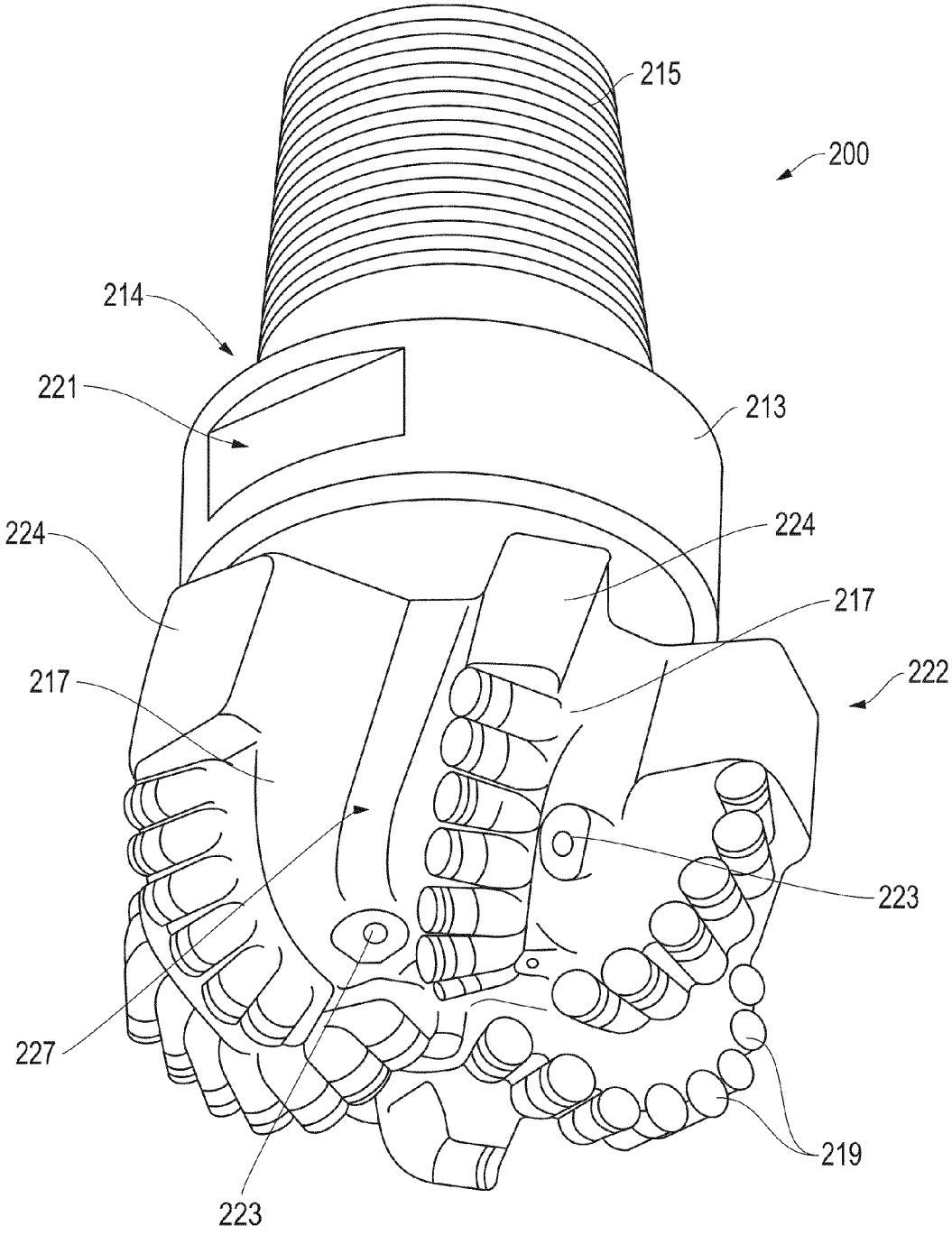
FIG. 2 includes a perspective view of a drill bit in accordance with an embodiment.

FIG. 2 includes a perspective view of a fixed cutter drill bit according to an embodiment. As shown in FIG. 2, the fixed cutter drill bit 200 can include a bit body 213 which may be connected to a shank portion 214 via a weld. The shank portion 214 can include a threaded portion 215 for connection of the drill bit 200 to other components of the BHA. The drill bit body 213 can further include a breaker slot 221 extending laterally along the circumference of the drill bit body 213 to aid coupling and decoupling of the drill bit 200 to other components.

The drill bit 200 includes a crown portion 222 coupled to the drill bit body 213. As will be appreciated, the crown portion 222 can be integrally formed with the drill bit body 213 such that they are a single, monolithic piece. The crown portion 222 can include gage pads 224 situated along the sides of protrusions or blades 217 that extend radially from the crown portion 222. Each of the blades 217 extend from the crown portion 222 and include a plurality of cutting members 219 bonded to the blades 217 for cutting, scraping, and shearing through earth formations when the drill bit 200 is rotated during drilling. The cutting members 219 may be tungsten carbide inserts, polycrystalline diamond compacts (PDC), milled steel teeth, or any suitable hard material. Coatings or hardfacings may be applied to the cutting members 219 and other portions of the bit body 213 or crown portion 222 to reduce wear and increase the life of the drill bit 200.

The crown portion 222 can further include junk slots 227 or channels formed between the blades 217 that facilitate fluid flow and removal of cuttings and debris from the well bore. Notably, the junk slots 227 can further include openings 223 for passages extending through the interior of the crown portion 222 and bit body 213 for communication of drilling fluid through the drill bit 200. The openings 223 can be positioned at exterior surfaces of the crown portion 222 at various angles for dynamic fluid flow conditions and effective removal of debris from the cutting region during drilling.

Figure 3:
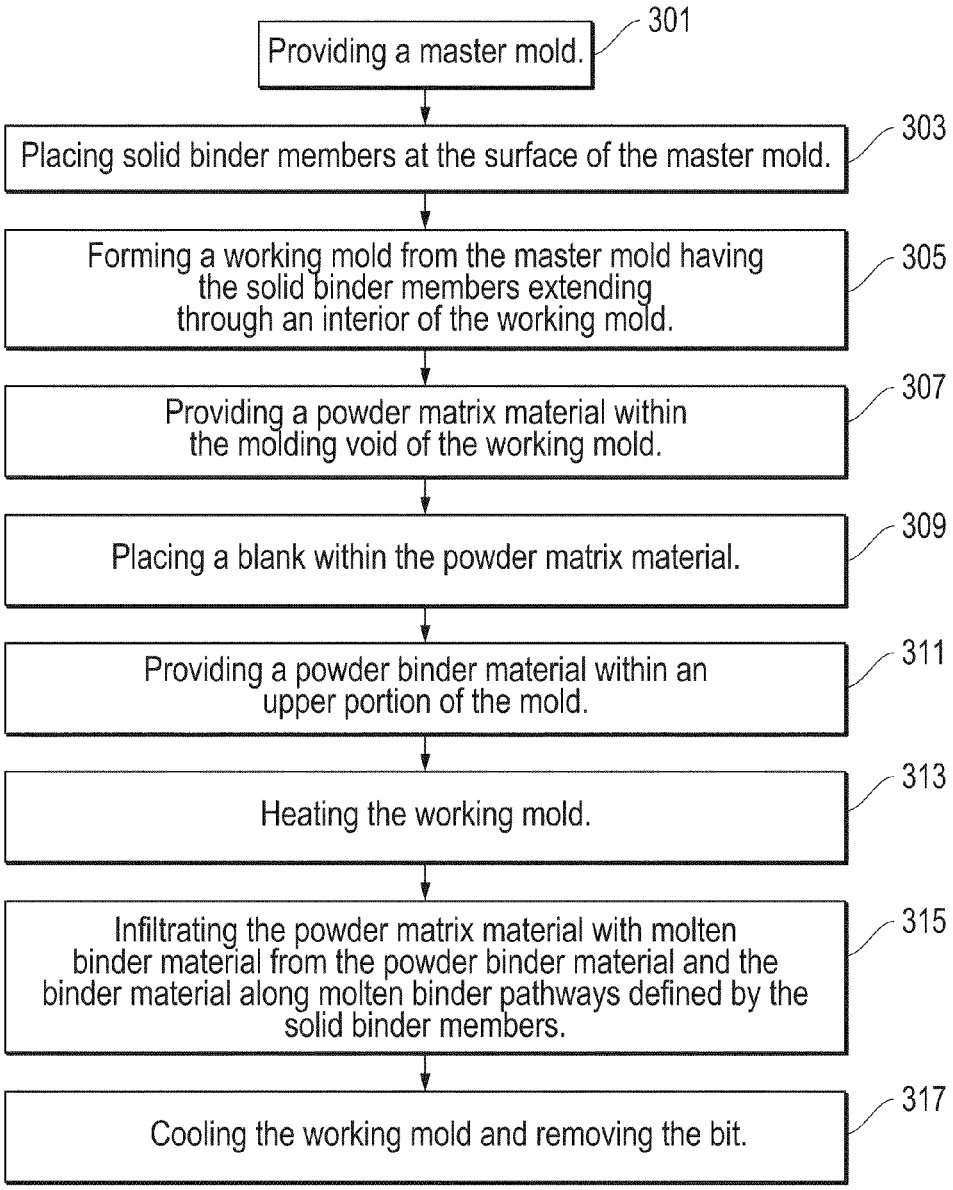
FIG. 3 includes a flowchart illustrating a method of forming a drill bit in accordance with an embodiment.
Figure 4:
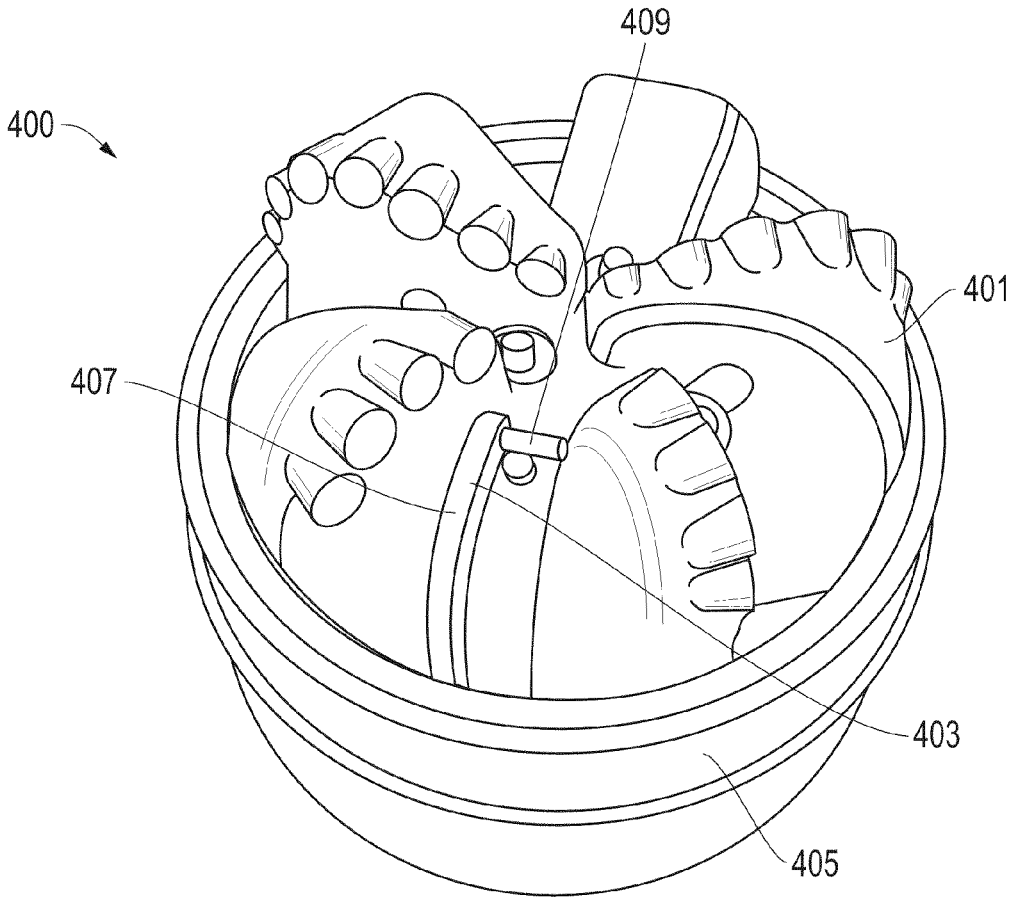
FIG. 4 includes an illustration of a master mold including a solid binder member in accordance with an embodiment.

FIG. 3 includes a flowchart illustrating a method of forming a bit in accordance with an embodiment. In particular, the method is initiated at step 301 by providing a master mold. The master mold can have a shape in the form of the final-formed drill bit such that it is suitable for forming a working mold therefrom. Referring briefly to FIG. 4, an illustration of a master mold in accordance with an embodiment is provided. The master mold 400 includes a master mold body 401 having the shape of a crown portion of a drill bit, including blades, junk slots, openings, and depressions within the blades for the placement of cutting members therein.

The master mold body 401 can be made of an organic material (natural or synthetic), an inorganic material, or a combination thereof. For example, certain suitable master molds are made of a polymer material, such as rubber.

Referring again to FIG. 3, after providing the master mold at step 301, the process can continue by placing solid binder members at a surface of the master mold. Referring again to FIG. 4, a solid binder member 403 is illustrated as being placed at a surface of the master mold body 401. The solid binder member 403 can be coupled to the surface of the master mold body 401 for proper placement of the solid binder member 403 during casting of the working mold from the master mold. Suitable forms of connecting the solid binder member 403 to the master mold body 401 can include use of adhesives, such as glue. Alternatively, the solid binder member 403 can be coupled to the master mold body 401 using mechanical engagement methods, such as through bonding, welding, or even use of fasteners. In accordance with an embodiment, the mold 400 can utilize a gage ring 405 provided around the periphery of the master mold body 401 which provides a surface to which the solid binder member 403 can be coupled for proper placement of the solid binder member 403 with respect to the master mold body 401.

A plurality of solid binder members can be connected to the master mold body 401 at different surfaces. In particular, the solid binder members can be arranged such that they are spaced at equal distances from each other. Moreover, each of the solid binder members can be arranged to contact the master mold body 401 at similar places. For example, as illustrated, the solid binder member 403 can be placed within a region of the master mold 400 defining a junk slot between the two blades within the final-formed drill bit. According to one particular embodiment, a plurality of solid binder members are displaced within each of the junk slots of the master mold 400.

As further illustrated in FIG. 4, the solid binder member 403 can be a solid, monolithic form. That is, in certain embodiments, the solid binder member 403 can be a rigid, polycrystalline component having sufficient mechanical strength for handling and manipulating for placement within the master mold 400. In alternative embodiments, the solid binder member 403 can include one or more openings. For example, the solid binder member 403 can be formed such that it has an opening extending through the body of the member. In certain instances, the solid binder member 403 can be a tube having an opening extending through the body defined by an inner diameter.

The solid binder member 403 can have a shape such that it fits the master mold body 401. In particular, the member can be formed to have a contour complementary to the contours of a portion of the working mold. For example, the solid binder member 403 can include an elongated body member 407, that can be curved to fit the contours of the junk slot. Additionally, an arm 409 can extend at an angle from the elongated body member 407. In certain instances, the arm 409 may extend from the elongated body member 407 at a substantially perpendicular angle such that it can suitably contact a surface of the master mold body 401, such as the rear surface of a blade opposite the surface of the blade having depressions for engagement of cutting members therein.

In accordance with a particular embodiment, the solid binder member 403 is a preformed member formed from binder materials. For example, the solid binder member 403 may be cast or molded using binder materials such that upon placement of the solid binder member 403 within the working mold, the solid binder member 403 is melted, thus forming a molten binder material that infiltrates powder matrix material within the working mold.

The binder material can be an inorganic material suitable for infiltrating certain powder matrix materials. For example, the binder material can include a metal or metal alloy including metals such as copper, nickel, zinc, tin, manganese, titanium, zirconium, hafnium, vanadium, niobium, tantalum, chromium, lead, molybdenum, tungsten, cobalt, iron, boron, silicon, phosphorous, and a combination thereof.

In certain embodiments, the binder material is a copper-based alloy comprising at least about 40 wt % copper of the total weight of the binder composition. In certain other embodiments, the amount of copper within the copper-based alloy can be greater, such as at least about 45 wt %, at least about 50 wt %, at least about 60 wt %, or even at least about 70 wt %. Certain embodiments utilizing the copper-based alloy binder include between about 45 wt % to 90 wt % copper, and more particularly between about 45 wt % and 80 wt % copper.

Additionally, such copper-based alloys can include additives that are present in a minor amount and can facilitate controlling certain processing parameters, such as the melting temperature of the binder material and the flow properties. Suitable additive metals can include metals such as zinc, tin, manganese, nickel, boron, iron, phosphorous, lead, silicon, or a combination thereof.

In certain embodiments, the copper-based alloy binder material contains some nickel. The nickel can be present in an amount of at least about 5 wt % of the total weight of the binder composition. In some instances, the amount of nickel may be greater, such as at least about 8 wt %, at least about 9 wt %, or even at least about 10 wt %. Copper-based alloy binder materials can utilize an amount of nickel within a range between about 5 wt % and 20 wt %, and more particularly within a range between about 8 wt % and 18 wt %.

The copper-based alloy composition may also include manganese, which can be present in amounts of at least about 3 wt % of the total weight of the binder composition. According to certain embodiments, the amount of manganese may be at least about 4 wt %, such as at least about 5 wt %, and particularly within a range between about 4 wt % and 10 wt %. Certain compositions can include between about 5 wt % to 8 wt % manganese. Still, other embodiments may utilize a greater amount, such that the copper-based alloy binder material contains between about 15 wt % to about 30 wt %, and more particularly, between about 20 wt % to 25 wt % of manganese.

Zinc may also be added to certain copper-based alloy compositions zinc, and can be present in amounts of at least about 3 wt % of the total weight of the binder composition. In some instances, the amount of zinc may be greater, such as at least about 4 wt %, at least about 5 wt %, or at least about 6 wt %, and particularly within a range between about 5 wt % and 10 wt %.

Another suitable additive used in the copper-based alloy binder materials is tin. The amount of tin is generally at least about 3 wt % of the total weight of the binder composition. For example, certain compositions can use at least about 4 wt %, or at least about 5 wt %, or even at least about 6 wt % tin. Still, the copper-based alloy binder materials herein typically utilize an amount of tin within a range between about 3 wt % and 10 wt %, and more particularly within a range between about 5 wt % and 7 wt %.

The binder material can have a binder melting temperature suitable for infiltration of a powder matrix material within the working mold. As such, the binder melting temperature is generally at least about 1000° C. In some processes, the binder melting temperature may be greater, such as at least about 1025° C., at least about 1050° C., at least about 1100° C., or even at least about 1150° C. Particular embodiments utilize a binder material having a binder melting temperature within a range between about 1000° C. and 1200° C.

According to certain alternative embodiments, the solid binder member 403 can be a composite material including some percentage of a second material. For example, the solid binder member can be a composite material including the binder material described herein combined with a second material, such as an organic material. An organic material may be used such that during a heating process, the binder material may volatilize or be removed leaving only the binder material. Some suitable organic materials can include natural organic materials such as wax. Other organic materials can include polymers, such as polystyrene.

Referring again to FIG. 3, after placing the solid binder members at the surface of the master mold at step 303, the process continues at step 305, by forming a working mold from the master mold, wherein the solid binder members extend through an interior of the working mold. Formation of the working mold can be completed by a casting process, wherein an inorganic, refractory material is cast around the master mold to form the working mold. The resultant working mold has a molding void in the shape of the drill bit defined by the surfaces of the master mold. As such, according to certain embodiments, the molding void has a volume of at least about 80 $in^3$, such as on the order of at least about 150 $in^3$, at least about 200 $in^3$, at least about 600 $in^3$, or even at least about 1500 $in^3$. Particular embodiments utilize a working mold having mold void volume within a range between about 200 $in^3$ and about 700 $in^3$.

Certain suitable materials for forming the working mold can include inorganic refractory materials such as ceramics. In accordance with one embodiment, the working mold is made of a material such as an oxide, phosphate, carbide, boride, or a combination thereof. In some instances, the working mold can include a carbide. In one embodiment, the working mold can be made such that it consists essentially of carbon, for example, the mold can be graphite.

The interior surface of the working mold defining the molding void can include a coating. Coatings can be formed on the interior surfaces such that during use, certain materials such as the powder matrix material or molten binder material do not adhere to or attack the interior surface of the mold causing corrosion and particle generation during processing. Coating materials can include inorganic materials such as ceramics. According to one embodiment, the coating can include a carbon-containing material (e.g., graphite) or can be an oxide, boride, carbide, or nitride. For example, on such coating material includes a boron-containing compound, such as boron nitride. It will be appreciated that certain portions of the interior surfaces may not be coated.

Figure 5:
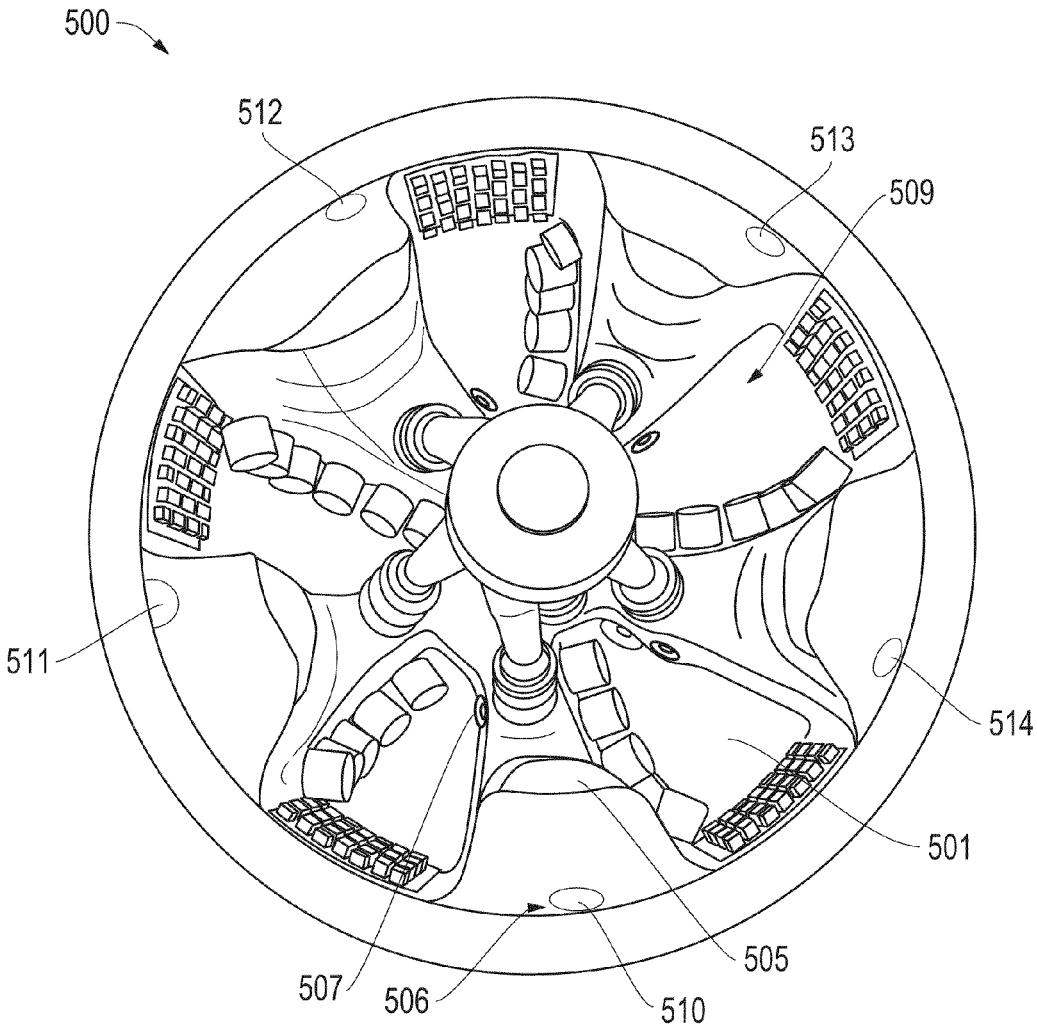
FIG. 5 includes an illustration of a portion of a working mold formed from a master mold incorporating solid binder members in accordance with an embodiment.

Referring to FIG. 5, an illustration of a portion of a working mold is provided in accordance with an embodiment. The portion of the working mold 500 is a bottom portion as will be evident in later figures, and includes a molding void 509 defined by the interior surfaces of the mold body 505 and defining the shape of a drill bit to be formed therein. Notably, the working mold body 505 can have a plurality of solid binder members 510, 511, 512, 513, and 514 (510-514) extending through the interior of the portion of the working mold 500. In particular, the solid binder members 510-514 define cavities within the interior of the portion of the working mold 500, which are filled with the solid binder members 510-514.

Moreover, the cavities defined by the solid binder members 510-514 can be in fluid communication with the molding void 509. As illustrated, the solid binder member 510 can define an entrance 506 at a surface of the working mold body 505 and an exit 507 at another surface of the working mold body 505 and thus a binder member pathway extending between the entrance 506 and exit 507 within the interior of the working mold body 505. Accordingly, the portion of the working mold 500 formed from the master mold 400 includes solid binder members 510-514 defining cavities filled with the solid binder members within the interior portions of the working mold body 505.

Notably, in one alternative embodiment, formation of pathways within the working mold body 509 may include the use of organic members. For example, certain embodiments may utilize organic members comprising an organic material bonded to particular regions of the master mold 401. The working mold body 501 can be formed from the master mold, such that the working mold body 501 comprises the organic members therein. The organic members can include an organic material having a particular volatilization temperature, such that upon heat treatment, the organic material is volatilized, leaving behind a pathway through the working mold body 501. Such pathways can be recesses, cavities, pockets or the like, depending upon the shape and placement of the organic material in the master mold. If desired, solid binder member can then be placed within the pathways or even affixed to the pathways.

The foregoing has described the formation of a working mold from a master mold. However, in other embodiments, the working mold can be formed directly from a block of material, otherwise a preform, without first forming a master mold. In such process, the preform can be machined by a milling process, for example, such that the preform is changed to a working mold having a molding void defined by interior surfaces suitable for forming a drill bit therein. The preform can be made of material such as a carbon-containing material, like graphite that is easily machined.

According to such forming methods, the process for placing a solid binder member 403, or a plurality of solid binder members, within the working mold is different than that of the foregoing processes utilizing a master mold. In particular, the process of can include machining a pathway into the preform suitable for engaging the solid binder member therein. Such a pathway can be formed to extend through an interior portion of the mold, such that it defines a cavity (See, cavities 691 and 692 of FIG. 6), wherein the majority of the surface area of the cavity is isolated within the working mold body.

Alternatively, in some embodiments, a pathway can be formed that is a recess or relief at an interior surface of the molding void. Generally, a pathway that is a recess travels along and intersects the interior surface defining the molding void for the entire length of the recess. In such embodiments, after the formation of the recess pathway, a solid binder member can be placed or affixed within the pathway prior to further processing. As will be appreciated, other types or combinations of pathways can be formed within the working mold, such as cavities, pockets, recesses, and the like.

Figure 6:
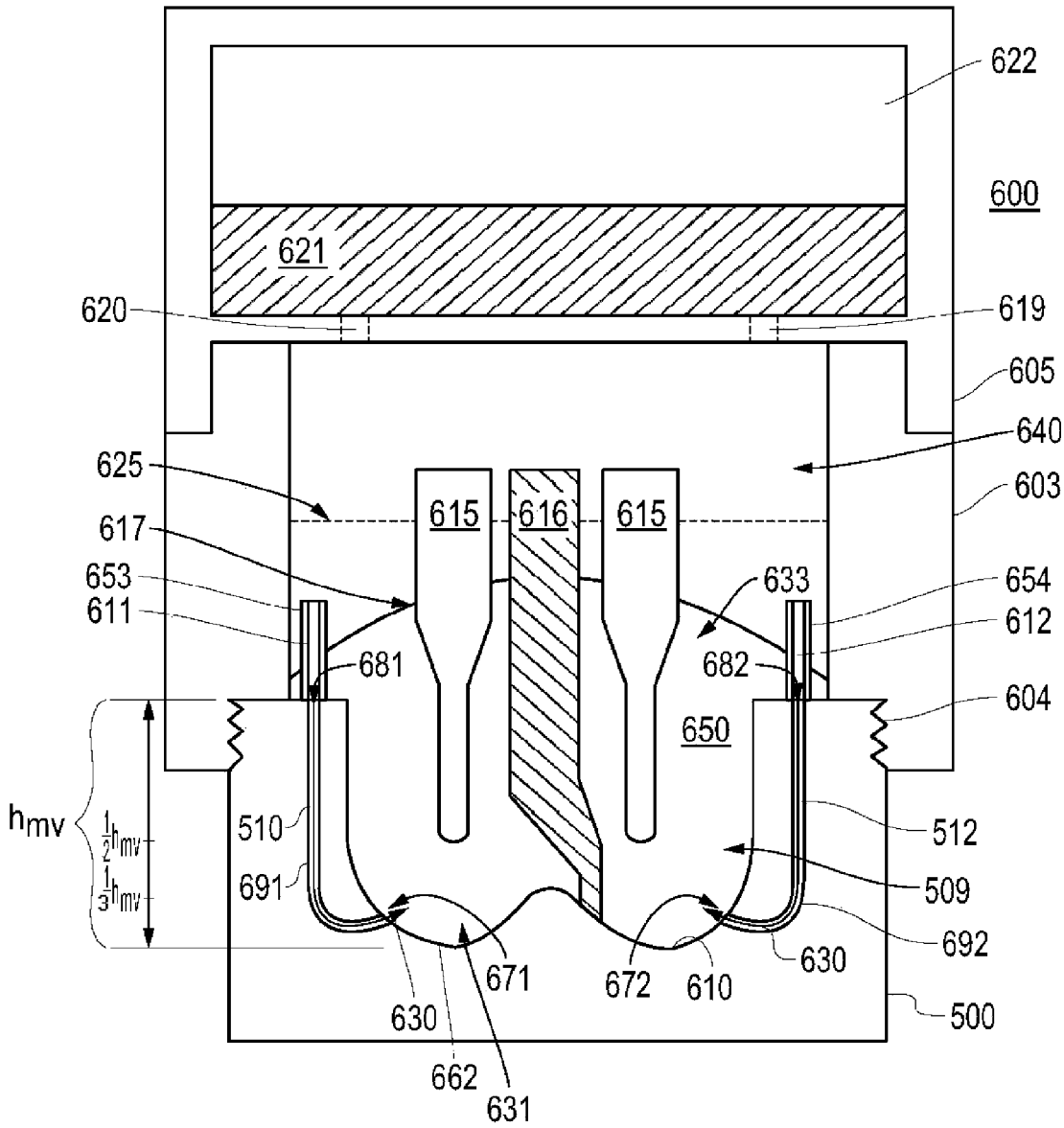
FIG. 6 includes a cross-sectional illustration of a working mold for forming a bit in accordance with an embodiment.

After forming the portion of the working mold 500, other components of the working mold may be assembled as illustrated in FIG. 6. In particular, FIG. 6 illustrates a cross-sectional view of a fully assembled working mold in accordance with an embodiment. In particular, the working mold 600 includes a bottom portion of the working mold 500 as previously illustrated in FIG. 5. Moreover, the working mold 600 can further include a middle portion 603 connected to the bottom portion 500, such as through a threaded connection 604. Furthermore, the working mold 600 can include a top portion 605 connected to the middle portion 603, through the same type of connection or alternatively a snap fit connection, or even by resting of the top portion 605 on the middle portion 603.

Referring again to the process provided in FIG. 3, after forming the working mold at step 305, and in some cases, after assembling the middle portion 603 and bottom portion 500 of the working mold 600 to each other, the process can continue at step 307 by providing a layer of powder matrix material 650 within the molding void 509 of the working mold 600. Referring again to FIG. 6, as illustrated, the layer of powder matrix material 650 can be provided within the bottom portion 500 of the working mold 600. It will be appreciated that in some instances, the middle portion 603 of the working mold 600 can be assembled to the bottom portion 500 before providing the layer of powder matrix material 650 if suitable for containing the amount of powder matrix material within the working mold 600.

The powder matrix material can be made of a material for forming a final-formed article having certain mechanical properties (hardness, toughness, etc.) suitable for use as a drill bit. Moreover, the powder matrix material 650 is suitable for infiltration by the binder material. In accordance with an embodiment, at least a portion of the powder matrix material 650 can include a ceramic material, such as a carbide. The carbide material can include a metal element, such as a transition metal carbide material. Particularly suitable carbide materials include tungsten carbide, such as cast tungsten carbide.

Cast carbides may generally be described as having two phases, for example, with respect to cast tungsten carbide, the two phases are tungsten monocarbide and ditungsten carbide. Cast carbides often have characteristics such as hardness, wettability and response to molten binder materials that are different from cemented carbide or spherical carbide materials. Notably, cast carbide powders may be substantially free of alloys or other contaminates associated with bonding materials used to form cemented carbides, that may reduce the amount of leaching of significant amounts of alloys or other potential contaminates that interrupt the infiltration process.

Notably, the cast tungsten carbide material can be a substantially pure material, including an amount of tungsten of at least about 90 wt %, such as at least about 92 wt %, and particularly within a range between about 92 wt % and about 96 wt %. The remainder of the balance is a majority of carbon content such that the carbon content is approximately within a range between about 3 wt % and about 5 wt %. Other impurities may exist within the composition such as iron, chromium, vanadium, titanium, tantalum, niobium, and other transition metals. Such impurity materials are typically present in amounts of not greater than about 0.5 wt %.

In accordance with one embodiment, the powder matrix material 650 can be made primarily of tungsten carbide, such that it is a tungsten carbide-based powder matrix material. Certain compositions can include at least about 60 wt %, such as at least about 70 wt %, at least about 80 wt %, or even at least about 90 wt % tungsten carbide for the total weight of the powder matrix material. Particular embodiments utilizing a majority amount of tungsten carbide within the powder matrix material 650 can do so in amounts within a range between about 60 wt % and about 98 wt %, such as about 70 wt % and about 95 wt %.

In the embodiments utilizing a powder matrix material 650 consisting essentially of a cast tungsten carbide material, the powder material can have an average particulate size of less than about 500 microns, such as not greater than about 400 microns, not greater than about 300 microns, not greater than about 200 microns, or even not greater than about 150 microns. In particular instances, the average particle size of the cast tungsten carbide powder matrix material 650 is within a range between about 1 micron and about 150 microns.

The cast tungsten carbide powder matrix material can have a distribution of average particle sizes for suitable packing characteristics within the working mold 600. The distribution may be achieved by using different types or ranges of sieves for different percentages of the powder matrix material 650. For example, in particular embodiments, about 35 wt % to about 50 wt % of the total weight of the cast tungsten carbide powder matrix material can have an average particle size of greater than 140 microns, and particularly within a range between about 145 microns to about 210 microns (approximately U.S. Std. Sieve −70/+100). Moreover, about 15 wt % to about 30 wt % of the total weight of the cast tungsten carbide powder matrix material can have an average particle size within a range between about 100 microns to about 145 microns (approximately U.S. Std. Sieve −100/+140). Certain powder matrix materials may utilize a greater distribution, particularly of smaller particles, and thus about 10 wt % to about 20 wt % of the total weight of the cast tungsten carbide powder matrix material can have an average particle size within a range between about 75 microns to about 100 microns (approximately U.S. Std. Sieve −140/+200). Some embodiments may include a greater percentage of smaller particles and thus can have about 10 wt % to about 20 wt % of the total weight of the cast tungsten carbide powder matrix material having an average particle size within a range between about 30 microns to about 75 microns (approximately U.S. Std. Sieve −200/+400).

Additionally, according to those embodiments utilizing a tungsten carbide-based powder matrix material some minor amount of additives, such as metal or metal alloy components can be added to modify certain characteristics of the powder matrix material 650. In one embodiment, the tungsten carbide powder matrix material incorporates a transition metal, such as nickel, which can be present in amounts of at least about 5 wt %, such as at least about 8 wt %, or even at least about 10 wt %. Particular embodiments of the tungsten carbide-based powder matrix material generally do not include greater than about 20 wt % nickel, such that the amount of nickel can be within a range between about 5 wt % and about 15 wt %.

The nickel powder generally has an average particle size of less than about 150 microns. In particular, the majority of the particles within the nickel material can have an average particle size within a range between about 50 microns to about 150 microns.

Moreover, with respect to embodiments using a tungsten carbide-based powder matrix material, the powder can further include a polymer material for stabilization of the material during shipment. Some suitable polymer material can include propylenes, such as polypropylene, or even polypropylene ether glycol, or polyoxipropylene glycol.

In certain other instances, the powder matrix material 650 can be a metal-based or metal alloy-based material. For example, the powder matrix material 650 can be a metal-based material having a majority amount of metal or metal alloy components and a minority amount of carbide-containing materials. In such embodiments, the powder matrix material 650 can be a steel-based alloy, such that the powder matrix material contains at least about 50 wt % steel. The steel material can be a low carbon steel having amounts of carbon less than 1 wt % of the total weight of the steel composition, and as such, can be a high iron-content steel having an amount of iron of at least about 85 wt %, such as at least 88 wt %, and particularly within a range between about 90 wt % and 95 wt % iron. Other elements present within the steel component can include sulfur, phosphorus, silicon, manganese, copper, nickel, chromium, and molybdenum.

The steel-based powder matrix material can contain a majority amount of steel, such that the composition includes at least about 50 wt % steel for the total weight of the powder matrix material 650. Other embodiments may utilize an amount of steel of at least about 55 wt %, such as at least 60 wt %, or even at least about 70 wt %. The amount of the steel within the powder matrix material 650 may not be greater than about 80 wt %, such that the amount of steel is within a range between about 50 wt % and about 75 wt %, and more particularly within a range between about 55 wt % and about 70 wt %. In one certain application, the powder matrix material 650 includes about 60 wt % steel.

Generally, the steel-based powder matrix material 650 includes particles that can be sieved such that a suitable particle distribution and packing characteristics are achieved. The particles of the steel generally have an average particle size of not greater than about 200 microns. More particularly, the particle size of the steel can be less, such as not greater than about 175 microns, not greater than about 150 microns, and particularly within a range between about 25 microns and 150 microns.

In further reference to the steel-based powder matrix material, the composition can include a certain, minority amount of a carbide material. In accordance with one particular embodiment, the steel-based alloy powder matrix material includes tungsten carbide. Suitable amounts of tungsten carbide can be at least about 20 wt %, such as at least about 30 wt %, at least about 40 wt %, but not greater than about 49 wt %. In fact, certain embodiments utilize an amount of tungsten carbide within a range between about 30 wt % and about 45 wt %.

The steel-based alloy can include certain types of tungsten carbide such as a cast tungsten carbide. In particular, the cast tungsten carbide particles may be sieved such that a suitable particle-sized distribution exists for a proper tap density when the powder matrix material is settled within the working mold. The average particle size and particle size distributions are similar to those described herein with regard to the tungsten carbide-based powder matrix material.

As will be further appreciated, the layer of powder matrix material 650 can include additional layers of powder therein. For example, in certain embodiments, after placing the powder matrix material within the molding void, a second layer of powder matrix material may be placed over the powder matrix material, such as a "shoulder" powder, which aids removal of excess binder and machining of the drill bit after forming.

The shoulder powder can include a metal or metal alloy. For example, in certain embodiments the shoulder powder comprises, tungsten. In particular instances, the shoulder powder incorporates a crystalline tungsten material, such that the shoulder powder consists essentially of crystalline tungsten.

Still, in certain embodiments, such as those wherein the powder matrix material comprises a steel-based alloy, the shoulder powder can include some content of steel to facilitate bonding between the steel-based alloy powder matrix material and shoulder powder material. In such embodiments, the steel-containing shoulder powder material, can include at least about 50 wt % steel powder. In other embodiments, the shoulder powder can include a greater content of steel powder, such as within a range between about 50 wt % and about 70 wt %. Such steel-based alloy shoulder powder can be further combined with some other metal powder, such as a tungsten metal. Still, such tungsten material is generally crystalline tungsten.

After placing the powder matrix material 650 within the working mold 600, the process can further include a packing the layer of powder matrix material 650 such that is has a suitable density within the bottom portion 500 of the working mold 600. Packing of the powder matrix material 650 can include vibration of the mold or other similar methods to obtain a suitable packed density of the powder matrix material 650.

As illustrated in FIG. 6, the bottom portion 500 of the working mold 600 is illustrated as including the solid binder members 510 and 512 previously illustrated in FIG. 5. In particular, the solid binder members 510 and 512 extend through the interior of the bottom portion 500 of the working mold 600 and can protrude above the upper surface of the bottom portion 500, and more particularly, above the level of the powder matrix material 650 within the working mold 600. According to one embodiment, the solid binder members 510 and 512 can include extension members 611 and 612, which are elongated bodies aiding the passage of the solid binder members 510 through the layer of powder matrix material 650. The extension members 611 and 612 can be coupled to the solid binder members 510 through use of an adhesive, or alternatively may be heat treated to form a physical bond between the two components. In accordance with a particular embodiment, the extension members 611 and 612 have a length such that they extend sufficiently to a top surface 617 of the layer of powder matrix material 650.

As described herein, the extension members 611 and 612 can be made of the same material as the solid binder members 510 and 512. More particularly, the extension members 611 and 612 can include coatings 653 and 654, respectively. The coatings 653 and 654 can be provided around an exterior surface of the extension members 611 and 612. According to one embodiment, the coatings 653 and 654 can include a layer or multiple layers of material wrapped around the extension members 611 and 612 made of a material having sufficient strength at high temperatures to avoid deformation or slumping. As such, in one embodiment, the coatings 653 and 654 can be made of a ceramic material, such as an oxide, carbide, nitride, boride, or combination thereof. For example, the coatings 653 and 654 can include a carbon-containing material, such as graphite, and more particularly can be a malleable graphite material, such as Grafoil™. The coatings 653 and 654 can maintain the position of the extension members 611 and 612 relative to the position of the solid binder members 510 and 512 during high temperature processing, and more particularly may allow for penetration of additional molten binder material to a bottom region 631 of the layer of powder matrix material 650 during processing.

Referring again to the method of FIG. 3, after providing the powder matrix material within the molding void at step 307, the process continues by placing a blank within the powder matrix material. Referring again to FIG. 6, the blank 615 is illustrated as being disposed within the powder matrix material 650 such that upon completion of the infiltration process, the blank 615 is secured to and chemically bonded to the final formed drill bit. In particular, the blank 615 can provide a material that is more easily machined and suitable for coupling to another component, such as the shank portion. In accordance with one particular embodiment, the blank 615 is made of a metal or a metal alloy, such as steel. As further illustrated, the blank 615 may have an opening therein for extension of a material 616 therethrough and down to the interior surface 610 of the mold void 509 such that suitable openings are maintained within the final formed drill bit. Such openings will facilitate formation of openings (e.g., nozzles) for fluid flow through the drill bit.

Notably, the provision of a blank 615 within the layer of powder matrix material 650 can further include the provision of a solid binder member extending through the interior of the blank 615. For example, one or more solid binder members can be placed within the interior of the blank 615, positioned in a manner similar to that of the material 616, particularly such that the solid binder member protrudes through a bottom surface of the blank 615. Provision of a solid binder member within the interior of the blank 615 can aid delivery of molten binder material to the bottom region 631 of the mold during the infiltration process. It will be appreciated, that placement of a solid binder member within the interior of the blank 615 may be done in addition to the placement of the material 616, which is typically a sand material. Thus, the process can include formation of a composite member including the sand material with a solid binder member contained therein. As such, the blank will contain the material 616 within an interior space, and the material 616 will contain a solid binder member within its interior space.

After suitably placing the blank 615 within the powder matrix material at step 309, the process can continue by providing a powder binder material within an upper portion of the mold at step 311. Referring again to FIG. 6, the working mold 600 can include an upper portion 605 that is attached to the middle portion 603. In particular, the upper portion 605 can have a chamber 622 suitable for housing a powder binder material 621 therein. As illustrated, the powder binder material 621 can be contained within the chamber 622 such that it is over the powder matrix material 650 contained within the bottom portion 500 of the working mold 600.

Notably, the powder binder material 621 contained within the upper portion 605 can be considered a primary solid binder source material that is suitable for initiating infiltrating of certain portions of the layer of powder matrix material 650. The binder material forming the solid binder members 510 and 512 defining the cavities 691 and 692 within the bottom portion 500 of the working mold can be considered secondary solid binder source material that is suitable for initiating infiltration of portions of the layer of powder matrix material 650 different than the regions initially infiltrated by the powder binder material 621 (i.e., primary solid binder material). This is facilitated by the design, wherein the powder binder material 621 is contained in a region of the mold that is separate from the binder material making up the solid binder members 510 and 512.

Notably, the powder binder material can include the same material as used in the solid binder members 510 and 512, with the distinction that in certain instances the powder binder material 621 is a particulate material. As such, the powder binder material can include a particulate material, or oftentimes a pellet-shaped material, that can have an average particulate size of at least about 0.5 mm. Other embodiments utilize an average particulate size of at least about 0.7 mm, such as at least about 0.8 mm, and particularly within a range between about 0.5 mm to about 4 mm. In certain instances, the binder material can be provided in blocks having a largest dimension on the order of at least about 20 mm, such as at least about 25 mm and generally within a range between about 20 mm and about 30 mm.

As such, in some embodiments, the cavities 691 and 692 within the bottom portion 500 defined by the solid binder members 510 and 512, can instead be formed through alternative means, and may be formed to include a powder binder material therein. That is, certain embodiments may utilize secondary solid binder material within cavities 691 and 692 within portions of the working mold that comprise a powder binder material, as opposed to solid, polycrystalline binder members 510 and 512.

Referring again to FIG. 3, after providing a powder binder material within the upper portion of the mold at step 311, the process continues by heating the working mold at step 313. In particular, the process of heating can include heating the working mold 600, or the binder material components within the working mold, within a furnace. In particular, the heating process can use various types of heating mechanisms such as induction heating, microwave heating, and the like. For example, in some instance the process utilizes a thermally conductive working mold, such as graphite, and the process can include heating of the mold and the components therein. In other instance, an induction heating process can be utilized, wherein the components (i.e., binder material) contained within the mold are selectively heated. Moreover, heating can be completed in an ambient atmosphere, primarily an environmental mixture of nitrogen and oxygen, and further can be conducted at ambient pressures. Still, in certain processes, the atmosphere may be a non-oxidizing atmosphere.

Generally, the process of heating includes increasing the temperature of the binder materials to the melting temperature (i.e., the binder melting temperature). Accordingly upon reaching the binder melting temperature the powder binder material 621 can be turned to a molten state. In accordance with one embodiment, the upper portion 605 includes plugs 619 and 620 within a bottom surface of the upper portion 605. In particular, the plugs 619 and 620 may extend through the bottom surface of the upper portion and be made of a material that may melt upon heating thereby forming openings and allowing molten binder material to flow from the upper portion 605 to the middle portion 603 and infiltrate the upper region 633 of the layer of powder matrix material 650. In some alternative processes, the binder material may be placed directly on the layer of powder matrix material 650. In accordance with one embodiment, the plugs 619 and 620 can be made of a metal or metal alloy. For example, one suitable metal includes copper. In accordance with one particular embodiment, the plugs 619 and 620 consist essentially of copper.

Notably, the plugs 619 and 620 can be made of a material having a melting temperature (i.e., plug melting temperature) that is greater than the binder melting temperature. As such, upon heating to the melting temperature of the plugs 619 and 620, all of the powder binder material 621 has been converted to a molten state, and thus free flowing, which aids rapid infiltration of the layer of powder matrix material 650 without agglomeration. In certain instances, the melting temperature of the plugs 619 and 620 is at least 50° C. greater than the melting temperature of the binder material 621. In other instances, the plug melting temperature is at least about 100° C., such as at least 125° C., and more particularly within a range between about 100° C. and about 200° C. greater than the melting temperature of the powder binder material 621.

Moreover, upon reaching the binder melting temperature, the solid binder members 510 and 512 can be converted to a molten state, such that the binder material exits the interior of the bottom portion 500 of the working mold 600 along pathways 630. That is, the solid binder members 510 and 512 can be melted and form pathways of flowing molten binder material (i.e., molten binder pathways) through the interior of the working mold 600 via the cavities 691 and 692 that the solid binder members 510 and 512 previously defined therein. As such, the molten binder material from the solid binder members 510 and 512 infiltrates the powder matrix material 650 at a bottom region 631 of the layer of powder matrix material 650, that is opposite the top region of the layer of powder matrix material 650 where the powder binder material infiltrates.

The infiltration of molten binder material within the bottom region is facilitated by the design and placement of the solid binder members 510 and 512. As illustrated, the molding void 509 can have a height ($h_{mv}$) defined as the distance between the top surface 661 of the bottom portion 500 and a lower-most surface 662 defining the molding void 509. In particular, the solid binder members 510 and 512 define cavities 691 and 692 within the interior of the bottom portion 500 of the working mold 600 in fluid communication with the bottom half of the molding void 509. The cavities 692 and 692 filled with the solid binder members 510 and 512 are in fluid communication with a bottom half of the molding void 509, such that openings 671 and 672 are at a surface within the bottom half of the molding void 509, that is, below the ½ $h_{mv}$ mark as illustrated in FIG. 6. In particular embodiments, the cavities 692 and 692 filled with the solid binder members 510 and 512 are in fluid communication with the bottom third of the molding void, such that openings 671 and 672 are below the ⅓ $h_{mv}$ mark. Moreover, in certain instances, such as that illustrated in FIG. 6 the cavities 692 and 692 defined by the solid binder members 510 and 512 can be in fluid communication with a top region of the molding void 509, such as the regions proximate to the openings 681 and 682 within the bottom portion 500. Such openings were also illustrated and described as entrances at FIG. 5 (see, entrance 506). The design facilitates infiltration of the molten binder material of the solid binder members 510 and 512 of the bottom region 631 of the layer of powder matrix material 650.

As described herein, upon melting the plugs 619 and 620, molten binder material from the powder binder material 621 (i.e., primary solid binder material) exits the upper portion 605 of the working mold 600 and initiates infiltration at the upper region 633 of the layer of powder matrix material 650. In certain cases, the molten binder material 621 can fill the chamber 640 of the middle portion 603 to a level above the tops of the extension members 611 and 612, such as for example, to a level represented by the dashed line 625. Accordingly, the molten binder material 621 from the primary solid binder material originally contained within the upper chamber 640 may recharge the molten binder pathways such that molten binder material flows to the bottom region 631 of the layer of powder matrix material 650.

Notably, the binder material of the solid binder members 510 and 512 (i.e., the secondary solid binder material) may turn to a molten state and infiltrate the layer of powder matrix material 650 simultaneously with the powder binder material 621 (i.e., primary solid binder material) initiating infiltration of the top region 633 of the layer of powder matrix material 650. In more particular instances, the solid binder members 510 and 512 may be converted to a molten state and initiate infiltration of the bottom region 631 of the layer of powder matrix material 650 before the powder matrix material 621 leaves the chamber 622. As such, the molten binder material of the powder binder material 621 initiates infiltration of the top region 633 of the layer of powder matrix material 650 at a time after infiltration of the bottom region 631 by the molten binder material of the solid binder members 510 and 512.

The formation of molten binder pathways provide avenues for binder material to flow to certain regions of the powder matrix material, such as the bottom region 631, more rapidly than conventional infiltration methods. The infiltration process herein is a gravity-fed infiltration process using capillary action and gravity as the primary mechanisms for infiltration. However, the formation of molten binder pathways during processes facilitates the flow of molten binder material to regions of the layer of powder matrix material 650, such as the bottom region 633, that would otherwise be the last regions to be infiltrated. As such, the molten binder pathways are formed to have dimension suitable to affect proper infiltration. According to one embodiment, the molten binder pathways have average diameters corresponding to the dimensions of the solid binder members 510 and 512, and thus significantly greater than an average interparticle porosity within the powder matrix material. For example, the average diameter of the molten binder pathways can be at least about 2 mm. In other embodiments, the average diameter of the molten binder pathways is at least about 4 mm, such as on the order of about 6 mm, about 9 mm, or even about 12 mm. Certain embodiments utilize molten binder pathways having average diameters within a range between about 5 mm and about 15 mm.

Figure 7:
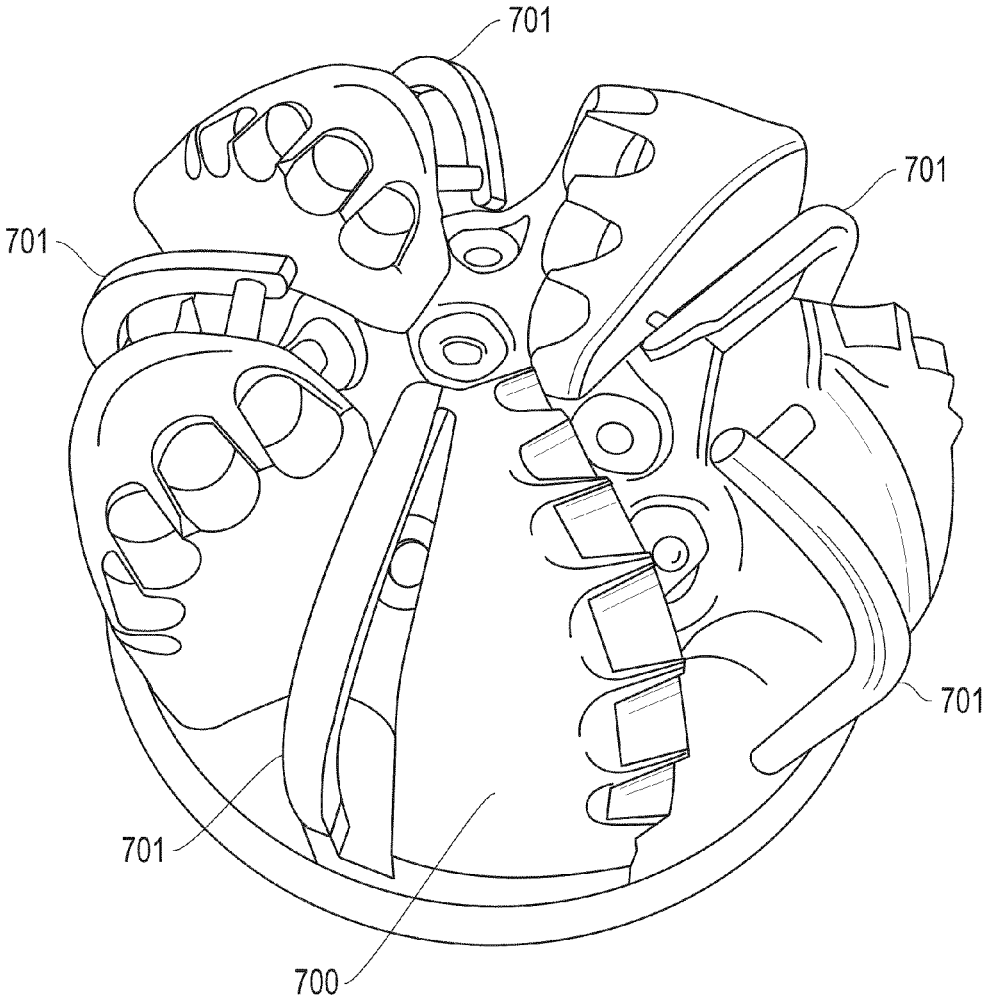
FIG. 7 includes an illustration of a drill bit after forming in accordance with an embodiment.

Referring again to FIG. 3, after infiltrating the powder matrix material at step 315, the process continues at step 317 by cooling the working mold 600 and removing the final formed drill bit from the mold at step 317. Removal of the drill bit can include destruction of the working mold, particularly the lower portion 500, in certain circumstances. Referring to FIG. 7, an illustration of a drill bit as removed from the working mold is provided in accordance with an embodiment. As illustrated, the final formed cast body 700 includes a series of cast binder members 701 attached to the cast body 700 within the junk slots of the drill bit. Notably, the cast binder members 701 consists essentially of binder material which did not infiltrate the body but was cooled and thus solidified in place of the molten binder pathways. The cast binder members 701 can be removed from the drill bit and the surfaces where the cast binder members when attached can be finished to provide a drill bit having a proper shape and appearance.

EXAMPLES

The following examples and illustrations provide a comparison between a drill bit formed according to a conventional infiltration process (Sample 1) and a drill bit formed according to the processes herein (Sample 2). Sample 1 was formed using a conventional infiltration method within a standard working mold similar to that illustrated in FIG. 6 without the use of solid binder members. Sample 2 was formed according to the processes herein, notably utilizing a working mold containing cavities and having solid binder members contained within the cavities. The solid binder members were rigid, fully densified members. Both samples used the same powder matrix material having the composition as provided in Table 1 below. A copper-based binder material having a composition of 45-57 wt % copper, 7-9 wt % zinc, 14-16 wt % nickel, 23-25 wt % manganese, and trace amounts of other materials such as boron, iron, phosphorous, lead, silicon, and tin was to infiltrate the powder matrix material. The binder had a melting point of 1090° C. Each of the samples were heated to a temperature of 1177° C. and held for a duration of 2.25 hours at the infiltration temperature, and thereafter cooled to room temperature. The atmosphere during the process was an ambient atmosphere.

TABLE 1

| Matrix Material | Wt % |
|---|---|
| Cast WC | 35-40 |
| Cast WC | 8-10 |
| Syl-Carb 100 Type 165 | 12-16 |
| Iron/Steel Powder | 30-35 |
| Nickel | 5-10 |
| Poly G | 0.1 |

Notably, after forming the drill bit samples according to each of the processes, a dye infiltration test was conducted on each of the samples. The dye infiltration test included cleaning the samples, exposing the samples to a dye by painting or coating a region of the sample with the dye and allowing the dye to infiltrate for about 30 minutes at room temperature. Excess dye can then be removed from the surface of the sample and the sample dried. After drying the sample, a developer is used to expose the region of the sample the dye has penetrated to indicate regions having substantial porosity, inclusions, or other features.

Figure 8:
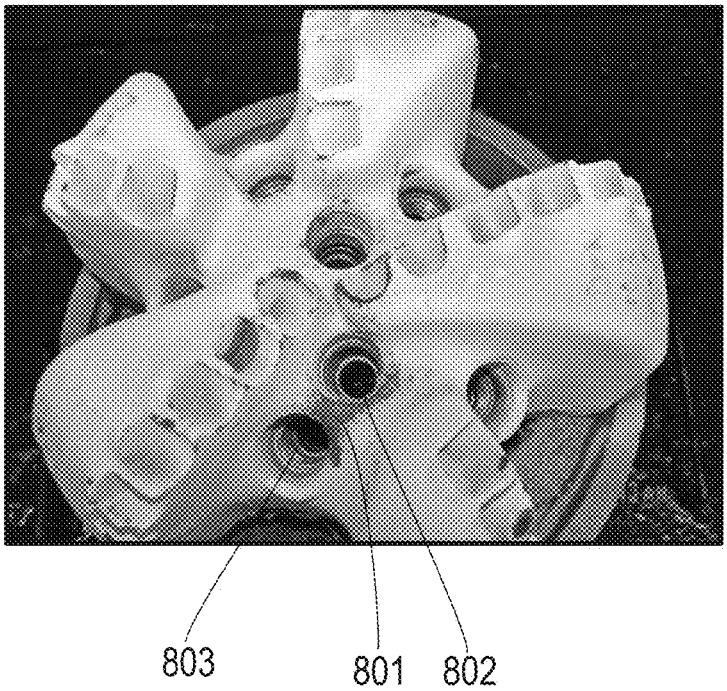
FIG. 8 includes an illustration of a drill bit formed according to a conventional process.

FIG. 8 includes an illustration of a drill bit (Sample 1) formed according the conventional process. As illustrated, the drill bit body demonstrated a colored region 801 indicative of a region the dye penetrated due to a high concentration of porosity. The colored region demonstrates a portion that was not properly infiltrated, resulting in a mechanically weakened region of the drill bit.

Figure 9:
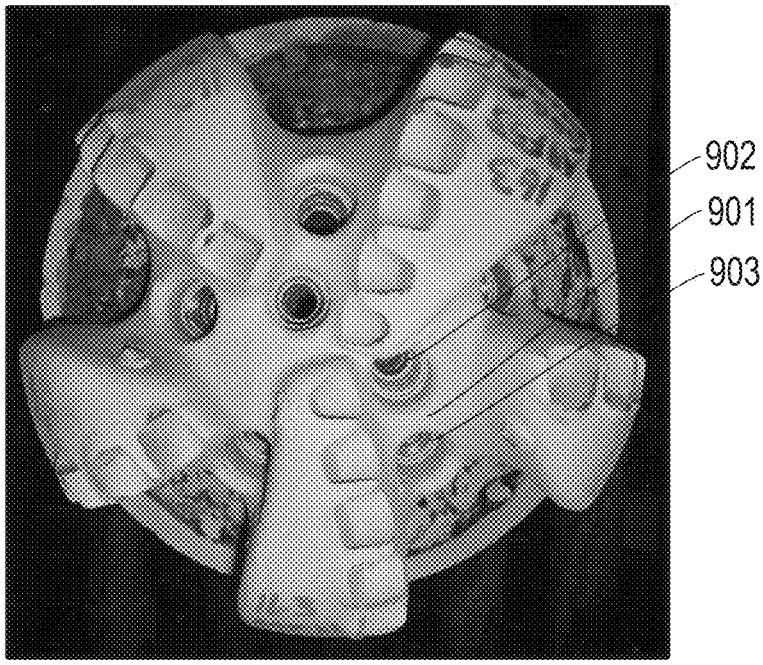
FIG. 9 includes an illustration of a drill bit formed in accordance with an embodiment The use of the same reference symbols in different drawings indicates similar or identical items.

By contrast, FIG. 9 illustrates a drill bit (Sample 2) formed according to the embodiments herein. In particular, the corresponding region 901 of the drill bit between the openings 902 and 903 demonstrates no coloration, thus indicating a region that has not been penetrated by the dye, and is properly infiltrated and lacking the open porosity demonstrated by the drill bit formed according to the conventional process. Accordingly, the corresponding region 901 has improved mechanical structure and properties in comparison to region 801 of Sample 1. The following comparative example demonstrates that use of features and processes described in accordance with embodiments herein facilitates the formation of a drill bits that are properly infiltrated, less susceptible to oxidation of the powder matrix material, and having improved compositional homogeneity and mechanical characteristics.

The methods and articles described in accordance with embodiments herein represent a departure from the state-of-the-art. In particular, the embodiments herein describe methods of forming drill bit through an infiltration processes utilizing a certain combination of features that facilitate infiltrating the layer of matrix powder material at multiple regions. Accordingly, the powder matrix material is infiltrated in a rapid manner without loss of head pressure thereby facilitating a more homogeneous composition of the final formed drill bit and further facilitating a drill bit less likely to exhibit interconnected porosity, oxidation, and/or oxide inclusion that are caused by oxidation of powder matrix material particles prior to be properly infiltrated by the binder material, which results in mechanically weakened regions. Such processes and features as described in embodiments here are particularly suitable for powder matrix materials utilizing steel-based materials, since such compositions are prone to rapid oxidation.

The above-disclosed subject matter is to be considered illustrative, and not restrictive, and the appended claims are intended to cover all such modifications, enhancements, and other embodiments, which fall within the true scope of the present invention. Thus, to the maximum extent allowed by law, the scope of the present invention is to be determined by the broadest permissible interpretation of the following claims and their equivalents, and shall not be restricted or limited by the foregoing detailed description.

The Abstract of the Disclosure is provided to comply with Patent Law and is submitted with the understanding that it will not be used to interpret or limit the scope or meaning of the claims. In addition, in the foregoing Detailed Description of the Drawings, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all features of any of the disclosed embodiments. Thus, the following claims are incorporated into the Detailed Description of the Drawings, with each claim standing on its own as defining separately claimed subject matter.

What is claimed is:

1. An infiltration method of forming an article comprising:

providing a working mold including a solid binder member extending through an interior of the working mold wall, wherein the solid binder member comprises a binder material;

providing a layer of powder matrix material within a molding void of the working mold; and heating the working mold to form a molten binder pathway from the solid binder member to infiltrate the layer of powder matrix material.

2. The method of claim 1, further comprising forming the solid binder member.

3. The method of claim 2, wherein forming the solid binder member comprises casting the solid binder member.

4. The method of claim 1, further comprising forming a master mold.

5. The method of claim 4, further comprising placing the solid binder member at a surface of the master mold.

6. The method of claim 5, wherein placing the solid binder member comprises affixing the solid binder member to a surface of the master mold.

7. The method of claim 5, further comprising forming the working mold from the master mold.

8. The method of claim 7, wherein forming the working mold comprises casting a working mold around the master mold and solid binder member to form a working mold having the solid binder member contained within the interior of the working mold.

9. The method of claim 1, wherein the solid binder member extends from the interior of the working mold and through a thickness of the layer of powder matrix material.

10. The method of claim 1, wherein the binder material comprises a copper-based alloy.

11. The method of claim 1, further comprising providing a layer of powder binder material over the powder matrix material.

12. The method of claim 1, wherein the powder matrix material comprises a metal or metal alloy.

13. The method of claim 12, wherein the powder matrix material comprises a metal selected from the group of metals consisting of iron, tungsten, nickel, and a combination thereof.

14. The method of claim 1, wherein the powder matrix material comprises a steel-based alloy.

15. An infiltration method of forming an article comprising:

providing a working mold comprising a wall defining a molding void for formation of an article therein, wherein the molding void comprises a molding void height ($h_{mv}$) between a bottom surface and a top surface, the working mold further comprising a cavity within an interior portion of the wall in fluid communication with a bottom half of the working void;

positioning a solid binder member within the cavity;

providing a layer of powder matrix material within the molding void; and heating the working mold to melt the solid binder member and infiltrating a bottom region of the layer of powder matrix material with molten binder material flowing from the cavity into the molding void.

16. The method of claim 15, wherein the cavity is in fluid communication with a bottom third of the working void.

17. The method of claim 15, wherein the molten binder material is generated from a secondary solid binder material contained within the cavity.

18. The method of claim 17, wherein the secondary solid binder material comprises a solid, polycrystalline binder member.

19. The method of claim 15, wherein infiltrating is completed via a gravity-fed infiltration process.

20. An infiltration method of forming an article comprising:

providing a layer of powder matrix material within a molding void of a working mold, wherein the molding void is defined by a working mold wall; and heating the working mold and forming a molten binder pathway from a solid binder member extending through an interior of the working mold wall of the working mold, the molten binder pathway flowing into the molding void to infiltrate the powder matrix material, wherein the molten binder pathway within the working mold wall has an average diameter significantly greater than an average interparticle porosity of the powder matrix material.

* * * * *